US010737297B2

(12) United States Patent
Michalak

(10) Patent No.: US 10,737,297 B2
(45) Date of Patent: Aug. 11, 2020

(54) STONE SIEVE APPARATUS

(71) Applicant: CNH Industrial America LLC, Racine, WI (US)

(72) Inventor: Adam Michalak, Kutno (PL)

(73) Assignee: CNH Industrial America LLC, New Holland, PA (US)

( * ) Notice: Subject to any disclaimer, the term of this patent is extended or adjusted under 35 U.S.C. 154(b) by 22 days.

(21) Appl. No.: 16/107,964

(22) Filed: Aug. 21, 2018

(65) Prior Publication Data

US 2019/0084007 A1 Mar. 21, 2019

Related U.S. Application Data

(60) Provisional application No. 62/548,226, filed on Aug. 21, 2017.

(51) Int. Cl.

| | |
|---|---|
| ***B07B 1/12*** | (2006.01) |
| ***E02F 3/14*** | (2006.01) |
| ***B07B 13/05*** | (2006.01) |
| ***B07B 1/00*** | (2006.01) |
| ***B07B 1/46*** | (2006.01) |
| ***B07B 13/00*** | (2006.01) |
| ***B07B 1/18*** | (2006.01) |
| ***E02F 7/06*** | (2006.01) |
| *B07B 15/00* | (2006.01) |

(52) U.S. Cl.

CPC ..... *B07B 13/05* (2013.01); *B07B 1/005* (2013.01); *B07B 1/12* (2013.01); *B07B 1/185* (2013.01); *B07B 1/46* (2013.01); *B07B 13/003* (2013.01); *E02F 7/06* (2013.01); *B07B 15/00* (2013.01)

(58) Field of Classification Search

CPC ..... B07B 1/005; B07B 1/12; B07B 1/185; B07B 1/4609; B07B 1/50; B07B 1/526; B07B 1/528; B07B 13/003; B07B 13/05; B07B 15/00; E02F 3/14; E02F 3/142; E02F 3/144; E02F 3/40; E02F 3/404

See application file for complete search history.

(56) References Cited

U.S. PATENT DOCUMENTS

| | | | | | |
|---|---|---|---|---|---|
| 760,590 | A * | 5/1904 | Vodra | B07B 1/12 | 209/393 |
| 1,187,238 | A * | 6/1916 | Beaumont | B07B 1/48 | 209/404 |
| 3,995,384 | A * | 12/1976 | Wood | E02F 3/40 | 37/446 |
| 4,521,305 | A * | 6/1985 | Deal | B01D 33/073 | 210/158 |
| 4,865,720 | A * | 9/1989 | Gilmore | B03B 9/061 | 209/12.1 |
| 6,364,119 | B1 * | 4/2002 | Graham | B07B 1/12 | 209/385 |

(Continued)

*Primary Examiner* — Joseph C Rodriguez

(74) *Attorney, Agent, or Firm* — Rebecca L. Henkel; Richard K. DeMille

(57) ABSTRACT

A stone sieve assembly includes a cutting blade, a back plate, and a plurality of bars. The plurality of bars are spaced apart from one another and extend between the cutting blade and the back plate. The plurality of bars have a leading section positioned proximate the cutting blade and a trailing section positioned proximate the back plate. The trailing section tapers inwardly as it approaches the back plate.

15 Claims, 9 Drawing Sheets

(56) References Cited

U.S. PATENT DOCUMENTS

| | | | | |
|---|---|---|---|---|
| 6,375,012 | B1 * | 4/2002 | Leyland | E02F 3/407 209/393 |
| 7,066,275 | B1 * | 6/2006 | Keigley | A01B 43/00 171/111 |
| 7,861,867 | B1 * | 1/2011 | Derrick | B07B 1/12 209/393 |
| 9,631,340 | B2 * | 4/2017 | Zimmerman | E02F 3/962 |
| 9,993,844 | B2 * | 6/2018 | Jenkins | B07B 1/12 |
| 2018/0094399 | A1 * | 4/2018 | Ollinger, IV | E02F 3/40 |
| 2018/0325008 | A1 * | 11/2018 | Martikainen | A01B 43/00 |

* cited by examiner

STONE SIEVE APPARATUS

CROSS-REFERENCE TO RELATED APPLICATIONS

This application claims priority under 35 U.S.C. § 119 to U.S. Provisional Patent Application No. 62/548,226, filed Aug. 21, 2017, entitled "Stone Sieve Apparatus," the entire contents of which are incorporated herein by reference for all purposes.

BACKGROUND

Stone pickers have long been used in the farming and landscaping industry to sieve through the layers of soil to separate and collect rocks and soil debris, while allowing useful topsoil to pass through and return to the top of the field. These layers of soil would be passed over a sieve formed of a series of bars which selectively allowed smaller material to pass through gaps between the bars, while keeping larger material, such as rocks, above the bars. Rotating tines aligned within the gaps between the bars would be used to then push the larger material off the surface of the sieve towards a receptacle, which could hold a large number of rocks and other material until it needed to be discarded. By removing these unwanted rocks and debris, damage to other farm machinery may be avoided and crops may experience better growing conditions.

While traditional stone sieves have proven to be very useful, they have a number of drawbacks. Sometimes, a stone enters the sieve in a "wrong" position, it may contact or direct a tine outward from an opening between the bars of the sieve. This causes the tine to make contact with at least one of bars of the sieve, which could damage the tine, bars, or both. Similarly, sometimes issues in manufacturing lead to misalignment of the tines and the bars of the sieve, such that tines may contact the bars of the sieve.

SUMMARY

Some embodiments of the invention provide a stone sieve that is configured to provide improved alignment between sieve bars and rotating tines. The stone sieve configuration promotes longer machine life and better durability without sacrificing the manufacturability of the stone sieve. In some embodiments, the distance between bars in the sieve varies along the length of the bars. The bars may have a first end having a first thickness and a second end having a second thickness greater than the first thickness. In some embodiments, the first end is proximal to the leading edge of the stone sieve, such that the gap between bars is greatest closest to the leading edge of the stone sieve.

In some embodiments, a stone sieve assembly is provided. The stone sieve assembly includes a cutting blade, a back plate, and a plurality of bars. The plurality of bars are spaced apart from one another and extending between the cutting blade and the back plate. The plurality of bars have a leading section positioned proximate the cutting blade and a trailing section positioned proximate the back plate. The trailing section of each bar tapers inwardly as it approaches the back plate.

In some embodiments, the plurality of bars includes a curved section extending between the leading section and the trailing section. The curved section can extend arcuately away from the leading section and tangentially toward the trailing section. The leading section and the curved section of each of the plurality of bars can have a rounded conveying surface. Optionally, the trailing section can be partially defined by a rounded conveying surface. The plurality of bars spaced apart from one another can include at least two distinct sizes of bars. In some embodiments, the plurality of bars are arranged so that each of the at least two distinct sizes of bars alternate within the array of bars. The plurality of bars spaced apart from one another can include bars defined by two different radii of curvature. In some embodiments, the plurality of bars spaced apart from one another extend away from the cutting blade to two distinct heights.

In some embodiments, each of the bars is supported by a rib extending away from the back plate. Each of the ribs can include a support surface, a cap, and a coupling surface opposite the support surface. The coupling surface can be adjacent to the back plate. In some embodiments, the cutting blade includes two independent blades. The cutting blade can include a first blade and a second blade, each of which can be formed of sheet steel having at least one bend. The first blade can include a plurality of tabs extending approximately tangent to the leading section of each of the plurality of bars. A series of mounting holes can be formed through the back plate within a gap formed between each bar. In some embodiments, guides are positioned on either end of the plurality of bars. The guides can be coupled to the cutting blade.

In some embodiments, the leading section of each of the plurality of bars extends angularly away from the cutting blade to a curved section, which extends arcuately and concavely away from the leading section to the trailing section. A gap can be formed between each adjacent bar. The gap can be wider between the trailing section two adjacent bars than between the leading section of two adjacent bars. The cross-sectional geometry of the bars varies between the leading section and the trailing section of the bars, and the leading section of the bars has a cross-section designed to direct a tine directionally away from a surface of the bar.

Some embodiments of the invention disclose a stone sieve system. The stone sieve system includes a rotor having a plurality of tines extending outwardly from the rotor. The tines are configured to rotate in concert with the rotor. The stone sieve system further includes a stone sieve assembly. The stone sieve assembly includes a cutting blade, a back plate, and a plurality of bars. The plurality of bars are spaced apart from one another and extending between the cutting blade and the back plate. The plurality of bars have a leading section positioned proximate the cutting blade and a trailing section positioned proximate the back plate. The trailing section of each bar tapers inwardly as it approaches the back plate. Each of the tines is aligned within a gap formed between two of the plurality of bars.

Some embodiments of the invention disclose a stone picking system. The stone picking system includes one or more rotatable rakes. The stone picking system also includes a rotor having a plurality of tines extending outwardly from the rotor. The tines are configured to rotate in concert with the rotor. The stone sieve system further includes a stone sieve assembly. The stone sieve assembly includes a cutting blade, a back plate, and a plurality of bars. The plurality of bars are spaced apart from one another and extending between the cutting blade and the back plate. The plurality of bars have a leading section positioned proximate the cutting blade and a trailing section positioned proximate the back plate. The trailing section of each bar tapers inwardly as it approaches the back plate. Each of the tines is aligned within a gap formed between two of the plurality of bars. One or more rotatable rakes are positioned outside the stone sieve assembly.

DESCRIPTION OF THE DRAWINGS

For the purpose of illustration, there are shown in the drawings certain embodiments of the present invention. It should be understood, however, that the invention is not limited to the precise arrangements, dimensions, and instruments shown. Like numerals indicate like elements throughout the drawings. In the drawings.

DETAILED DESCRIPTION

Figure 1:
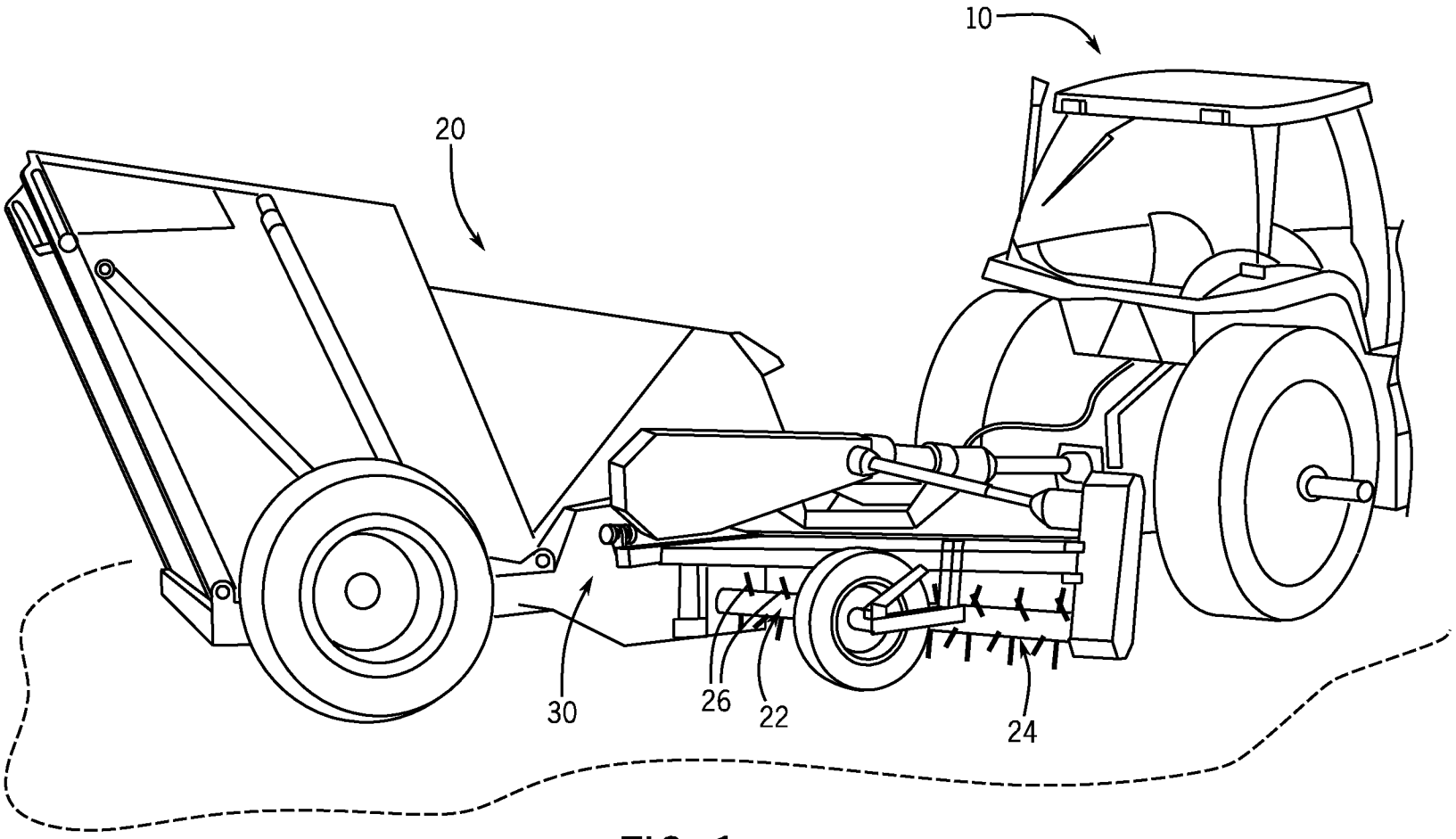
FIG. 1 is a perspective view of a tractor hauling a stone picking device according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a vehicle 10 pulling a stone picking device 20 according to one embodiment of the invention. The vehicle 10 may be a tractor, all-terrain vehicle (ATV), utility task vehicle, automobile, or other vehicle capable of transporting stone picking device 20. The vehicle 10 can drive across fields or other terrain to collect and remove stones and other undesirable objects that may affect crop growth, crop planting, or crop harvesting.

The stone picking device 20 is designed to travel along the surface of a field and can remove rocks and other unwanted debris from the ground below. In some embodiments, the stone picking device 20 includes a raking system 22 designed to direct stones towards the middle of the stone picking device 20. The raking system 22 can be designed to follow the contours of uneven fields. In some embodiments, the raking system 22 has one or more rakes 24 that rotate in the opposite direction to forward travel. The rakes 24 can have a series of heavy duty spikes 26 made from high tensile steel. These heavy duty spikes 26 may be positioned in a spiral arrangement, so that the movement of the rakes 24 directs stones and other objects toward the center of the stone picking device 20, and onto a stone sieve system 30.

Figure 2:
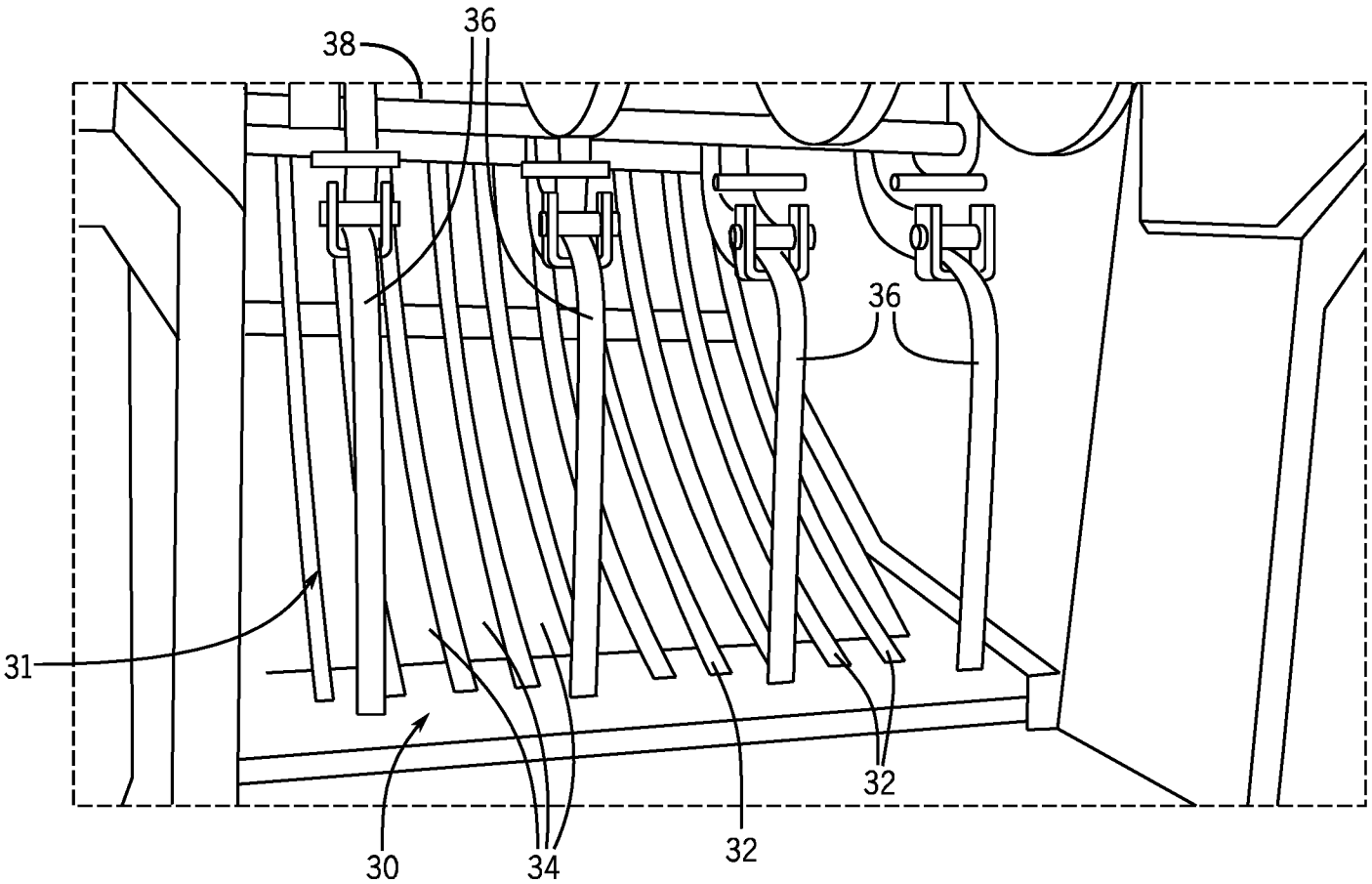
FIG. 2 is a perspective view of a stone sieve system according to embodiments of the disclosure, which can be present in the stone picking device of FIG. 1.

FIG. 2 illustrates the stone sieve system 30 that selectively removes rocks and other objects from the surface below. In operation, stones are sieved by tines 36 coupled to a rotor 38, which rotates above the bars 32 of a stone sieve assembly 31. The bars 32 are spaced apart from one another, so that gaps 34 are present between each bar 32. The gaps 34 may be sized to selectively allow objects (e.g., rocks) below a certain size to readily pass through the gaps 34, while restricting objects above the size threshold from passing through gaps 34. Accordingly, objects larger than the gaps 34 between bars 32 of the stone sieve system 30 remain on the bars 32 as the stone picking device 20 moves forward. The rotor 38 rotates, causing the tines 36 to rotate as well. Because the tines 36 are configured to be aligned between gaps 34 between the bars 32, they contact the material stuck on the bars 32 and throw the stones off the bars 32 into a hopper (not shown). The tines 36 can be a convex steel, and can be provided with a shape that optimizes tensile strength. A helper spring may support the tine 36 on the rotor 38 to assist in movement of large stones from the sieve 30. Similarly, the bars 32 may be formed of a high strength steel.

Figure 3:
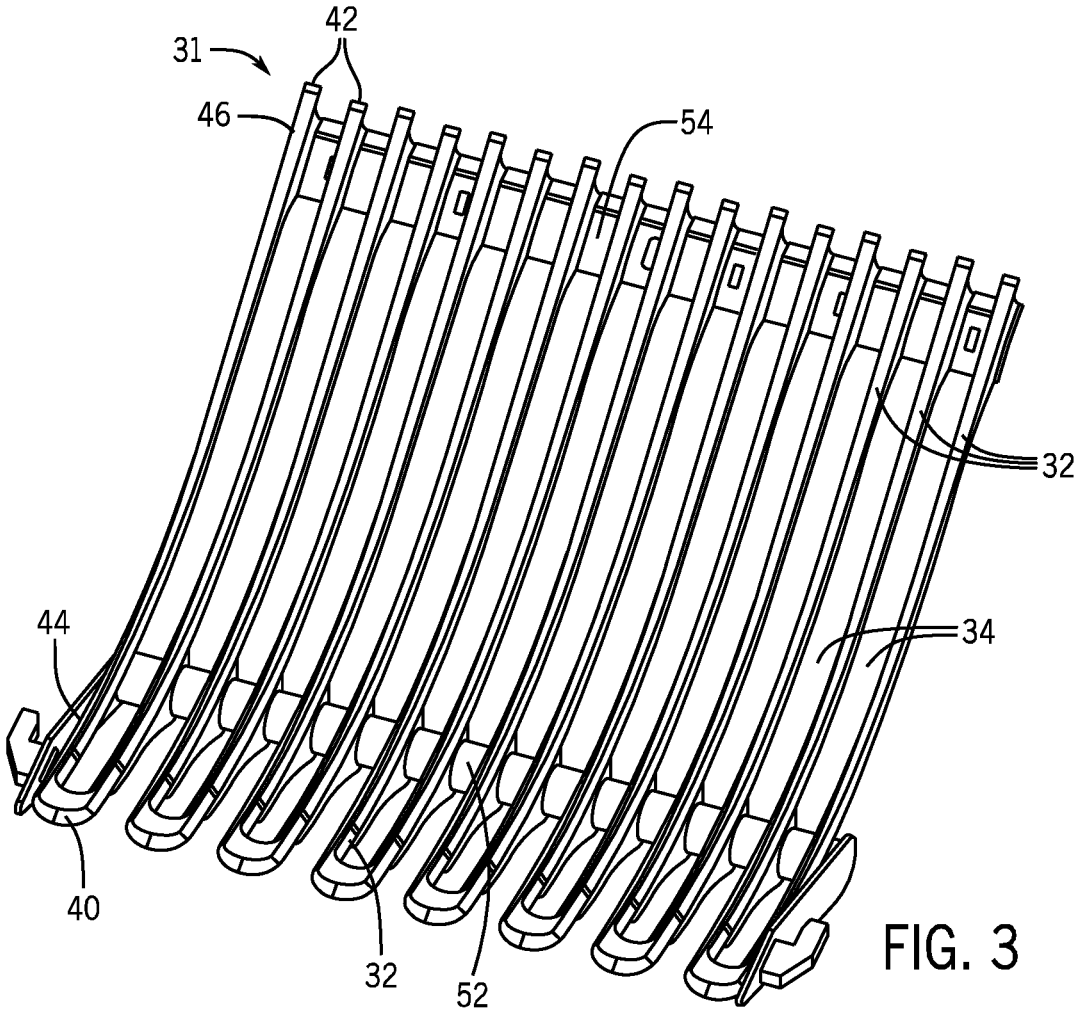
FIG. 3 is perspective view of a stone sieve assembly according to embodiments of the disclosure which can be used in the stone sieve system of FIG. 2.
Figure 4:
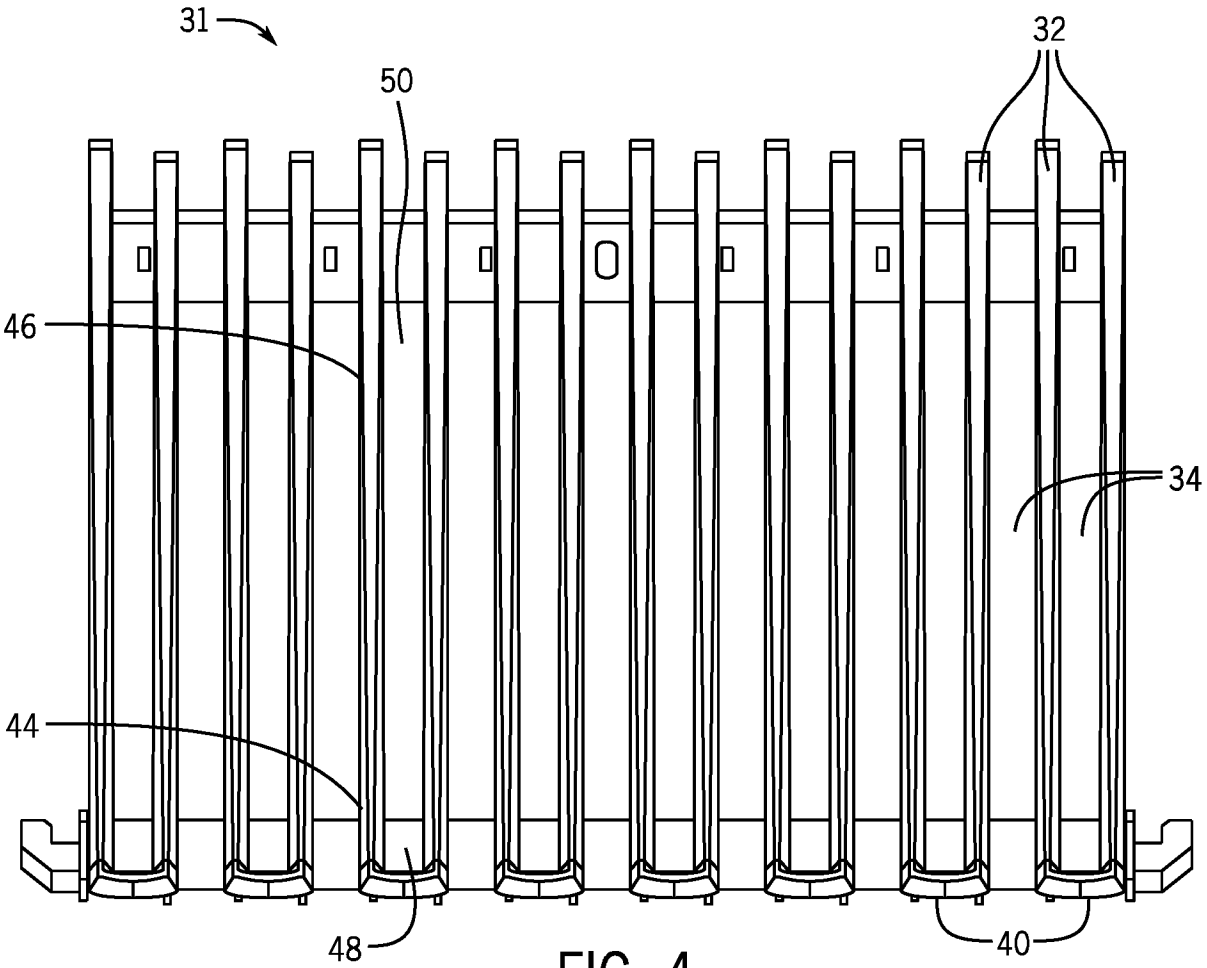
FIG. 4 is a front view of the stone sieve assembly of FIG. 3.
Figure 5:
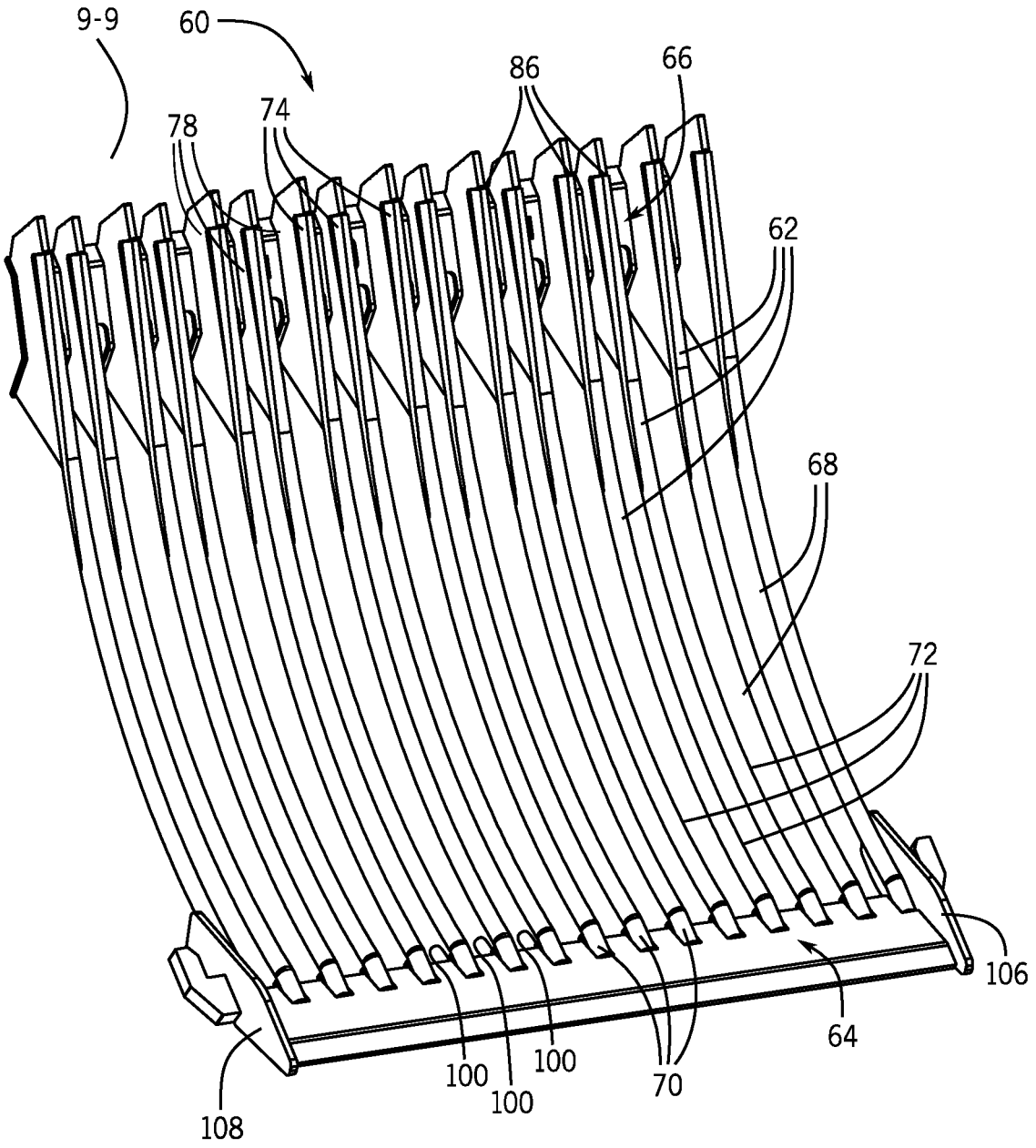
FIG. 5 is a perspective view of another stone sieve assembly according to embodiments of the disclosure, which can also be present in the stone sieve system of FIG. 2.
Figure 6:
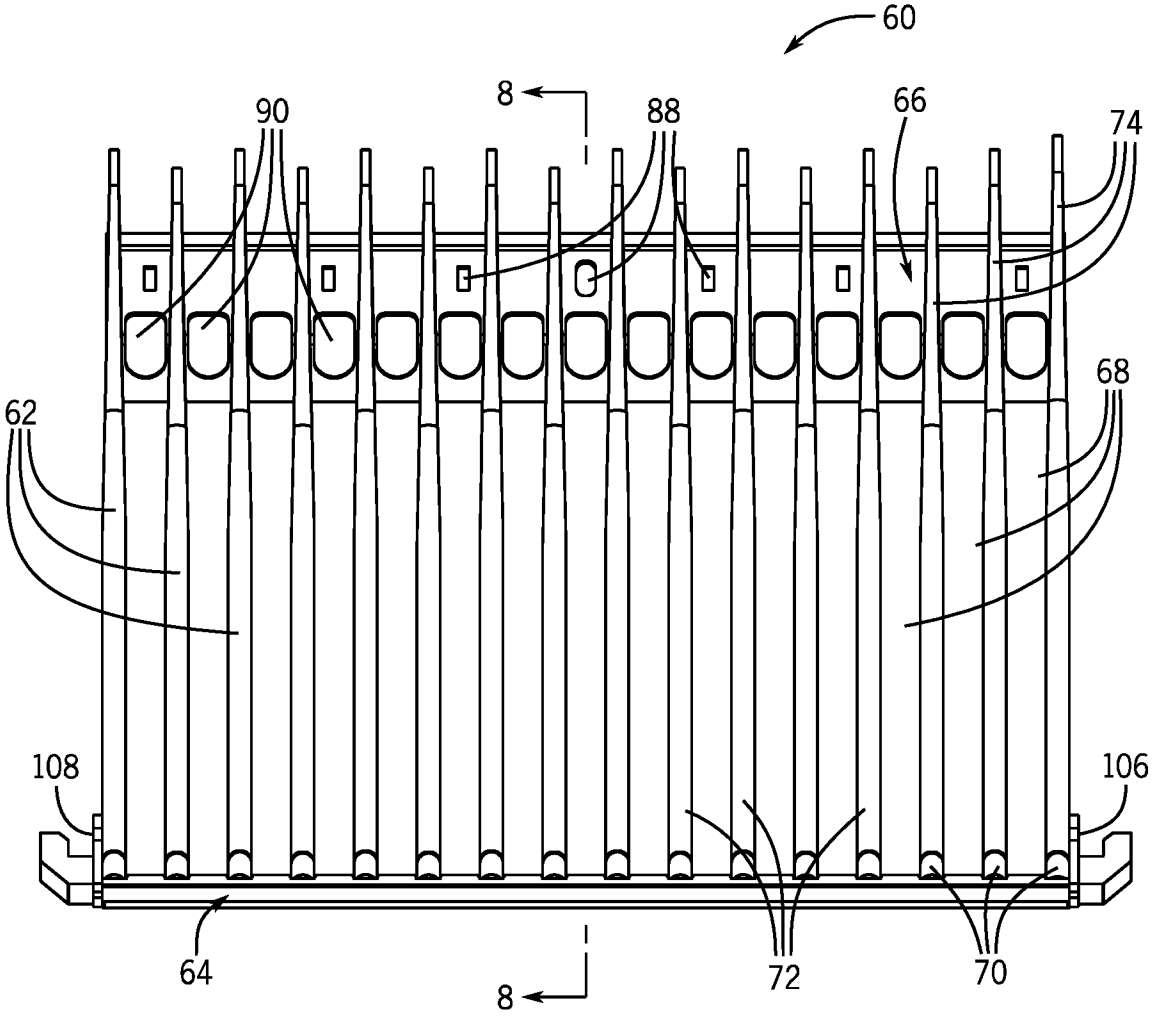
FIG. 6 is a front view of the stone sieve assembly of FIG. 5.
Figure 7:
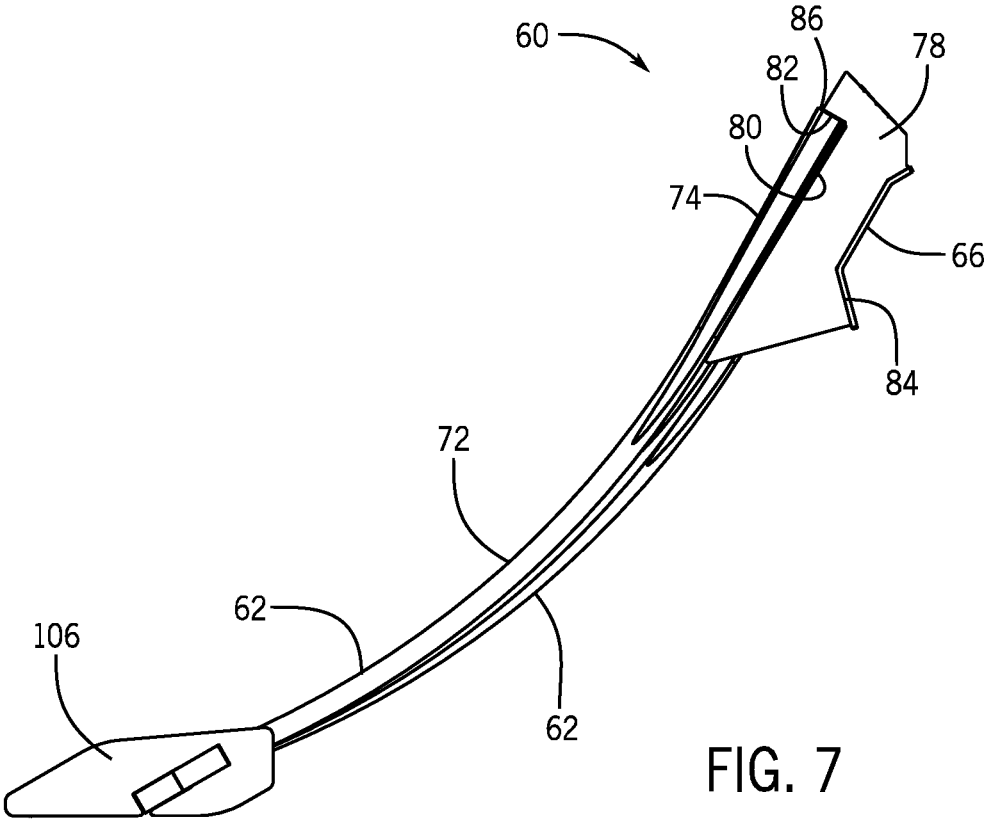
FIG. 7 is a right side view of the stone sieve assembly of FIG. 3.

Referring now to FIGS. 3-4, the stone sieve assembly 31 is shown in isolation. As discussed previously, the stone sieve assembly 31 includes an array of bars 32 spaced apart from one another to form gaps 34 that selectively determine what may and may not pass through the stone sieve assembly 31. In some embodiments, each bar 32 is spaced apart from one another approximately equally, so that the gap 34 between each bar 32 is approximately identical in size. Each bar 32 can be independent of other bars 32. Alternatively, two or more bars 32 may be coupled together. In some embodiments, adjacent bars 32 can be coupled to one or more adjacent bar 32 with a scooping edge 40, which may be shaped to travel along a rock picking surface (e.g., field) and produce a "scooping" function to lift soil, dirt, rocks, and other materials onto the stone sieve assembly 31. Each of the bars 32 may also be coupled to one another by support structures 52, 54. In some embodiments, the trailing edge 42 of the bars may extend away from coupling plate 54 to a distance different from each adjacent bar. Other possible orientations for the bars 32 of the stone sieve assembly 31 are explained in international application WO 2017/076415A1, which is hereby incorporated by reference in its entirety.

The bars 32 may be shaped so that tines 36 are directed by the bars 32 towards the gaps 34, which may prevent damage to both the tines 36 and the bars 32. The bars 32 may be provided with a lead section 44 and a trailing section 46, which may each have different cross-sectional geometry. For example, lead section 44 may comprise a geometry that tends to direct a tine 36 towards a nearby gap 34. In FIGS. 3-4, the lead section 44 has a nearly triangular cross-section, with the apex of the triangle being present on the top surface of the bar 32. Accordingly, if a tine were to contact a surface of the lead section 44, the tine would be directed one way or the other towards a gap 34, where it would then avoid solid, compressive contact with a bar 32, which could otherwise damage one or both of the tine 36 or bar 32.

As the bar 32 extends away from the lead section 44 towards the trailing section 46, the cross-sectional geometry may change. For example, the triangular cross-section of the lead section may flatten out, such that the trailing section 46 has a substantially flat conveying surface. The flat surface may provide an easier surface for transporting rocks or other material stuck on the sieve 30, as the flattened section does not allow rocks or other unwanted material to lodge itself between bars 32. For at least this reason, the flattened trailing sections 46 of the bars 32 can help convey rocks upward off of the stone sieve assembly 31, toward the hopper (not shown) to remove them from the surface below.

As stated earlier, the spacing between each bar 32 may be approximately equal, such that the coarseness of the sieve 30 is nearly constant throughout, and the leading section gap 48 is nearly equal to the trailing section gap 50. However, the cross-sectional geometries between the leading section 44 and trailing section 46 are such that the leading section 44 has a greater tendency to direct a tine one way or the other, and leading section gap 48 is a better tine receiver than trailing section gap 50.

In another embodiment, the spacing between each bar 32 may vary. Each bar 32 can be positioned at an acute angle to the nearest bar, such that a larger leading section gap 48 is present between adjacent bars than the trailing section gap 50. In still other embodiments, the cross-section of the leading section 44 of each bar 32 is designed to be thinner than the cross-section of the trailing section 46, such that gap 34 decreases in size as it moves from the leading section gap 48 to the trailing section gap 50.

Referring now to FIGS. 5-9, an alternative embodiment of a stone sieve assembly 60 is shown. Like the stone sieve assembly 31 discussed above, the stone sieve assembly 60 can be included in the stone sieve system 30, and can be used to remove rocks and other unwanted objects from a field or surface below the stone picking device 20.

The stone sieve assembly 60 includes an array of bars 62 that extend between a cutting blade 64 and a back plate 66. The bars 62 can be evenly spaced laterally apart from adjacent bars 62 to form a series of gaps 68, and can a generally concave bend to direct rocks and other unwanted objects upward, off the stone sieve assembly 60 to the hopper (not shown). The bars 62 may have different lengths or curvatures, depending on the location of the bar 62. For example, alternating bars 62 can have uniform shape and sizing, while adjacent bars 62 may differ in curvature or length. The alternating bar 62 array can act as a cradle, which may support and balance rocks or other objects as they are pushed upward off of the stone sieve assembly 60.

The bars 62 can be formed of a generally round bar stock, and can have a varying cross-sectional geometry as they extend between the cutting blade 64 and the back plate 66. For example, the bars 62 can each have a leading section 70, a curved section 72, and a trailing section 74. The leading section 70 can have a generally cylindrical shape that extends acutely away from the cutting blade 64. The curved section 72 extends upwardly and arcuately away from the leading section 70, forming a trough. The trailing section 74 extends upwardly and tangentially away from the curved section 72, to the back plate 66. The trailing section 74 can have a substantially flat supporting surface 76, which can be used to help convey objects away from the curved section 72 off of the stone sieve assembly 60. Additionally, the trailing section 74 can taper inwardly (and narrow) as it extends upward toward the back plate 66, so that the gap 68 between adjacent bars 62 is larger between the trailing section 74 than it is between either of the curved section 72 or the leading section 70.

The rounded nature of the bars 62 can help bias rotating tines 36 into the gaps 68 between bars 62, rather than onto the bars 62 themselves. The circular or near circular cross-section of the bars 62 is such that a tine 36 will be directed away from the bar 62 (and into a subsequent gap 68 between bars 62) unless the tine 36 makes direct contact with the bar 62 along its centerline. If the tines 36 have even a minor amount of flexibility (e.g., 5 degrees of allowable rotation), they will be directed off of the bar 62, and will avoid direct, compressive contact that could damage or even break tines 36 entirely off of the stone picking device 20. Because the tines 36 are all coupled to the same rotor 38, the proper alignment of the rotor 38 (and each of the tines 36) relative to the stone sieve assembly 60 will also be maintained. The inward-tapering trailing section 74 of each bar 62 can also reduce the stress on individual tines 36 as they rotate with the rotor 38 upward toward the back plate 66, by limiting the amount of contact tines 36 have with bars 62. Because the gap 68 is wider proximate the trailing section 74, additional and unnecessary contact between the tines 36 and the bars 62 near the top of the stone sieve assembly 60 can be avoided. Accordingly, the wear (e.g., frictional wear from contact between a bar 62 and a tine 36) experienced by each tine 36 during operation can be reduced, and the overall life of the stone sieve assembly 60 and stone sieve system 30 can be improved.

Figure 9:
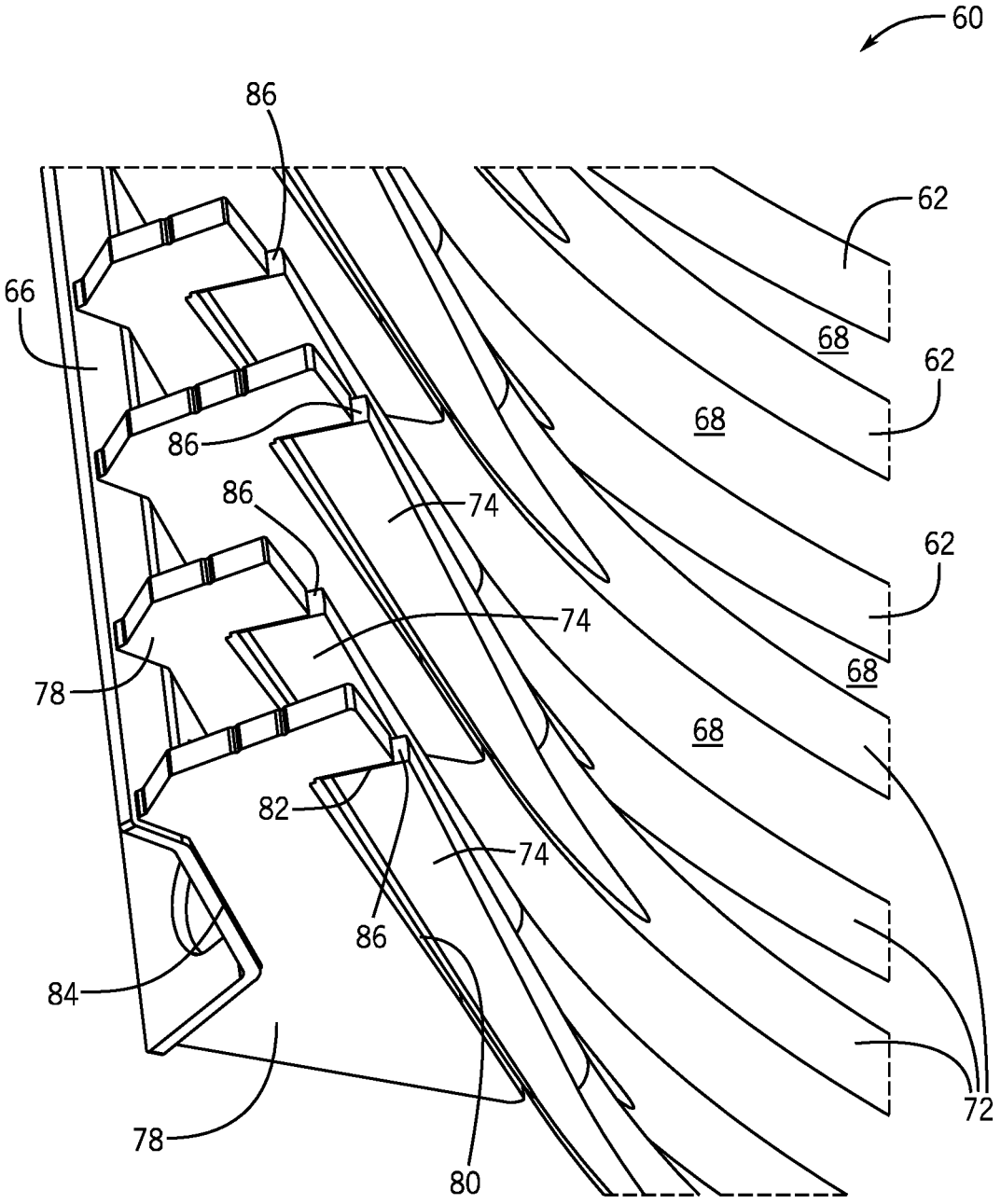
FIG. 9 is a detailed perspective view of the stone sieve assembly of FIG. 5, displaying the reinforcing ribs and support structure used to couple tines to one another and taken along the section line 9-9 in FIG. 5.

The bars 62 can each be supported by ribs 78 extending away from the back plate 66. As shown in FIG. 9, the ribs 78 can include two distinct shapes and sizes to accommodate for the difference in length and curvature between adjacent bars 62. The ribs 78 can be formed from a plate steel, and can be designed to include a support surface 80, a cap 82, and a coupling surface 84. The support surface 80 can be a generally flat surface that extends approximately parallel to the trailing section 74 of the bar 62 it supports. In some embodiments, the trailing section 74 of the bar 62 can be welded to the rib 78 to couple and support the bar 62. Alternatively, a small clearance can be present between the rib 78 and the bar 62, so that the bar 62 can flex, vibrate, or otherwise dissipate shock loading experienced by stones and other objects contacting the bars 62 as they are transported off of the stone sieve assembly 60. The cap 82 can extend above a portion of the trail end 86 of the bar 62 that the rib 78 supports. In some examples, the cap 82 extends above at least half of the trail end 86 of the bar 62 that the rib 78 is associated with. The coupling surface 84 is positioned on the rib 78 opposite the support surface 80, and can be coupled to the back plate 66. For example, each rib 78 can be welded to the back plate 66.

The coupling surface 84 of each rib 78 can have one or more bends to receive the back plate 66, which also includes a series of bends. The bends in the back plate 66 can increase the overall rigidity of the back plate 66, and increases the strength of the overall stone sieve assembly 60. A series of locating holes 88 and coupling holes 90 can be formed through the back plate 66 to allow the stone sieve assembly 60 to be readily coupled to the stone sieve system 30 or the stone picking device 20. The locating holes 88 and coupling holes 90 can receive a series of fasteners (not shown) or other coupling devices to removably or non-removably couple the stone sieve assembly 60 to the stone sieve system 30.

Figure 8:
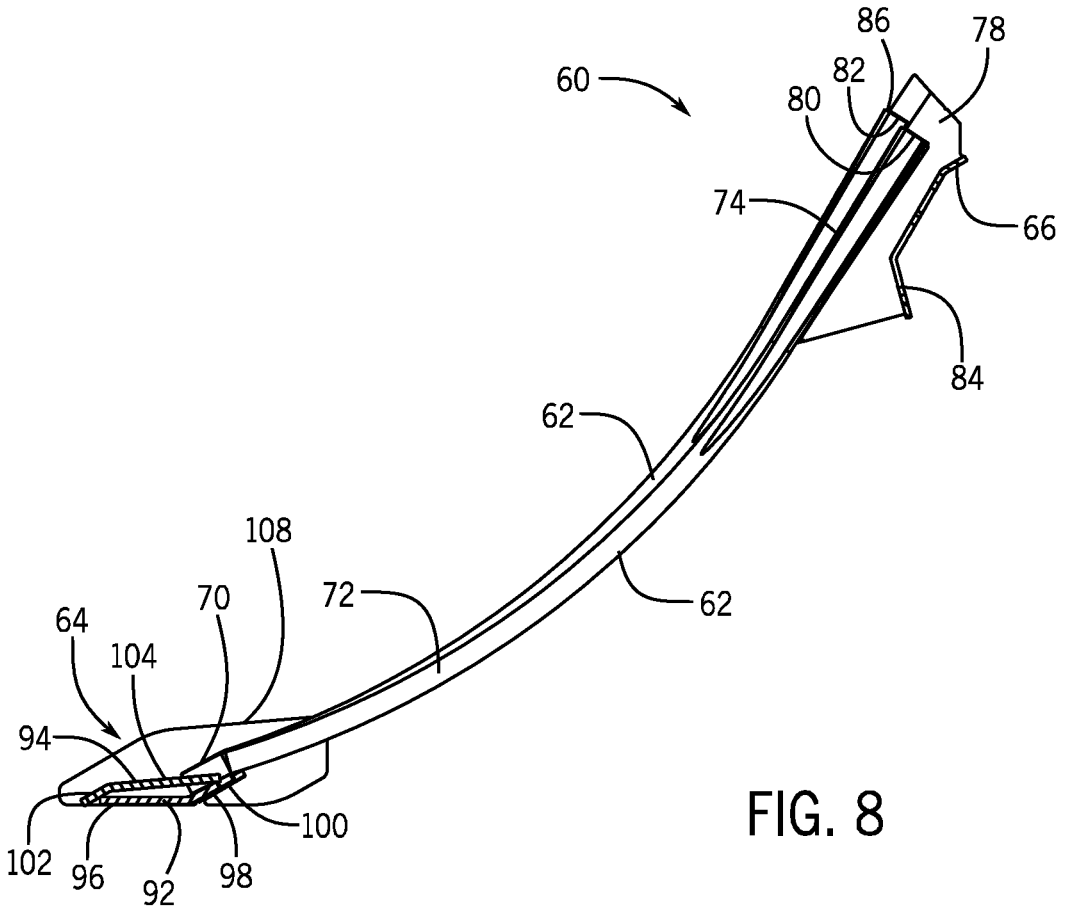
FIG. 8 is a cross-sectional view of the stone sieve assembly of FIG. 5, taken along the section line 8-8 in FIG. 6.

As shown in FIG. 8, the cutting blade 64 can be formed of two or more separate blades 92, 94. The first blade 92 can have a first section 96 extending approximately parallel to the surface below, as well as a second section 98 angling upward away from the first section 96. The first section 96 of the first blade 92 can extend away from the underside of the bars 62, while the second section 98 can help support the leading section 70 of each bar 62. For example, a series of tabs 100 can extend rearward and approximately tangent to each of the leading sections 70 of the bars 62 to support the bars 62 during stone picking operations. The second blade 94 can also be divided into a first section 102 and a second section 104. The first section 102 extends above and acutely away from the first section 96 of the first blade 92. The second section 104 extends upwardly away from the first section 102 to form an obtuse angle with the first section 102. This combination of blades 92, 94 allows the cutting blade 64 to lift earth and other objects (e.g., rocks) up from the surface of the ground, up onto the leading section 70 of the bars 62. The sharpened lead edge of the second blade 94 can cut or otherwise remove roots and other unwanted materials from the ground surface below. In some embodiments, the blades 92, 94 can be flexibly coupled to one another, so that the first blade 92 can support the second blade 94 as it enters into the ground below. In some embodiments, the blades 92, 94 are each formed of plate steel, which gives the blades 92, 94 strength without requiring a solid blade.

Guides 106, 108 can be positioned on either side of the cutting blade 64 to further ensure that rocks and other objects are moved upward onto the bars 62, rather than outward from the stone sieve assembly 60. The guides 106, 108 can be welded to the outer edges of the cutting blade 64, and can extend upward above the cutting blade 64 to surround the leading section 70 of each of the bars 62. In some examples, the guides 106, 108 each extend forward beyond the cutting blade 64 as well.

While the stone sieve assemblies 31, 60 has been described as being suitable for agricultural applications, it should be appreciated that the stone sieve assemblies 31, 60 may be used in a variety of other situations. For example, the stone sieve assemblies 31, 60 may be particularly useful in the construction industry, when sites need to be cleaned. Similarly, golf courses, football fields, and other turf sod operations may use the stone sieve assemblies 31, 60 to remove unwanted stones from the area.

These and other advantages of the present invention will be apparent to those skilled in the art from the foregoing specification. Accordingly, it is to be recognized by those skilled in the art that changes or modifications may be made to the above-described embodiments without departing from the broad inventive concepts of the invention. It is to be understood that this invention is not limited to the particular embodiments described herein, but is intended to include all changes and modifications that are within the scope and spirit of the invention.

The invention claimed is:

1. A stone sieve assembly comprising:

a cutting blade;

a back plate; and a plurality of bars spaced apart from one another and extending between the cutting blade and the back plate, the plurality of bars having a leading section positioned proximate the cutting blade and a trailing section positioned proximate the back plate, the trailing section tapering inwardly as the trailing section approaches the back plate, wherein the plurality of bars spaced apart from one another includes at least two distinct sizes of bars, and wherein the plurality of bars spaced apart from one another include bars defined by two different radii of curvature.

2. The stone sieve assembly of claim 1, wherein the plurality of bars comprise a curved section extending between the leading section and the trailing section.

3. The stone sieve assembly of claim 2, wherein the curved section extends arcuately away from the leading section and tangentially toward the trailing section.

4. The stone sieve assembly of claim 2, wherein the leading section and the curved section of each of the plurality of bars has a rounded conveying surface.

5. The stone sieve assembly of claim 4, wherein the trailing section is partially defined by a rounded conveying surface.

6. The stone sieve assembly of claim 1, wherein the plurality of bars are arranged so that each of the at least two distinct sizes of bars alternate.

7. The stone sieve assembly of claim 1, wherein the plurality of bars spaced apart from one another extend away from the cutting blade to two distinct heights.

8. A stone sieve assembly comprising:

a cutting blade;

a back plate; and a plurality of bars spaced apart from one another and extending between the cutting blade and the back plate, the plurality of bars having a leading section positioned proximate the cutting blade and a trailing section positioned proximate the back plate, the trailing section tapering inwardly as the trailing section approaches the back plate, wherein each of the bars is supported by a rib extending away form the back plate, and wherein each of the ribs includes a support surface, a cap, and a coupling surface opposite the support surface, and wherein the coupling surface is adjacent to the back plate.

9. The stone sieve assembly of claim 8, wherein the cutting blade includes two independent blades.

10. The stone sieve assembly of claim 9, wherein the cutting blade includes a first blade and a second blade, the first blade and second blade each being formed of sheet steel and each having at least one bend.

11. The stone sieve assembly of claim 10, wherein the first blade includes a plurality of tabs extending approximately tangent to the leading section of each of the plurality of bars.

12. A stone sieve assembly comprising:

a cutting blade;

a back plate; and a plurality of bars spaced apart from one another and extending between the cutting blade and the back plate, the plurality of bars having a leading section positioned proximate the cutting blade and a trailing section positioned proximate the back plate, the trailing section tapering inwardly as the trailing section approaches the back plate, wherein a series of mounting holes are formed through the back plate within a gap formed between each bar.

13. The stone sieve assembly of claim 12, wherein guides are positioned on either end of the plurality of bars, the guides being coupled to the cutting blade.

14. The stone sieve assembly of claim 12, wherein the leading section of each of the plurality of bars extends angularly away from the cutting blade to a curved section, which extends arcuately and concavely away from the leading section to the trailing section.

15. The stone sieve assembly of claim 12, wherein the gap formed between each adjacent bar is wider between the trailing section of two adjacent bars than between the leading section of two adjacent bars.

* * * * *